US010692669B2

(12) United States Patent
Yu

(10) Patent No.: US 10,692,669 B2
(45) Date of Patent: Jun. 23, 2020

(54) KEYBOARD AND KEY STRUCTURE THEREOF

(71) Applicant: Primax Electronics Ltd., Taipei (TW)

(72) Inventor: Tsu-Hui Yu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/217,237

(22) Filed: Dec. 12, 2018

(65) Prior Publication Data

US 2020/0111627 A1 Apr. 9, 2020

(30) Foreign Application Priority Data

Oct. 5, 2018 (TW) ..... 107135279 A

(51) Int. Cl.
*H01H 13/86* (2006.01)

(52) U.S. Cl.
CPC ..... *H01H 13/86* (2013.01); *H01H 2223/044* (2013.01)

(58) Field of Classification Search
CPC ..... H01H 13/86; H01H 2223/044
USPC ..... 200/5 A, 345
See application file for complete search history.

(56) References Cited

U.S. PATENT DOCUMENTS 5,380,969 A * 1/1995 Yang ..... H01H 13/705 200/290
5,516,996 A * 5/1996 Shin ..... H01H 13/705 200/345
6,759,613 B2 * 7/2004 Kurihara ..... H01H 13/70 200/314
9,646,786 B1 * 5/2017 Feng ..... H01H 13/86

* cited by examiner

*Primary Examiner* — Edwin A. Leon
*Assistant Examiner* — Lheiren Mae A Caroc
(74) *Attorney, Agent, or Firm* — Kirton McConkie; Evan R. Witt

(57) ABSTRACT

The present invention provides a keyboard and a key structure thereof, including: a lower cover, a fixed plate, a plurality of keys, a flexible protection cover, and an upper cover. The fixed plate is fixedly disposed on the lower cover, the keys are fixedly disposed on the fixed plate, the hollow protrusion structure of the flexible protection cover is configured to partially cover a key pedestal of the key, and a key support shaft of the key is correspondingly configured at a position of the opening of the flexible protection cover. The upper cover is disposed on the sheet-like body of the flexible protection cover and is assembled to the lower cover, and the hollow protrusion structure is located in a recess of the upper cover.

12 Claims, 5 Drawing Sheets

KEYBOARD AND KEY STRUCTURE THEREOF

FIELD OF THE INVENTION

The present invention relates to a structure of an input device, and in particular, to a keyboard having a water-proof and dust-proof function.

BACKGROUND OF THE INVENTION

In the modern society, the use of electronic devices has become an indispensable part of the life, and necessities such as eating, clothing, living, traveling, teaching, and entertainment are correlated to electronic devices. Generally, a keyboard structure is configured in a consumer electronic device.

Electronic devices are closely correlated to people's life. A user may accidentally splash a drink or water to a surface of an electronic device during use, and the drink or water penetrates into the electronic device through gaps between keys and a housing, further causing damage to the electronic device. In addition, dusts suspending in the air or dirt on the hands may enter the electronic device from the gaps between the keys and the housing, and therefore impact operating of the electronic device.

Therefore, how to provide a keyboard having a water-proof and dust-proof function and a key structure thereof is a technical issue to be resolved by the present invention.

SUMMARY OF THE INVENTION

A main objective of the present invention is providing a keyboard having a water-proof and dust-proof function and a key structure thereof.

To achieve the foregoing objective, the present invention provides a key structure, including:

a fixed plate;

a key pedestal, fixedly disposed on the fixed plate and having a key support shaft;

a keycap, coupled to the key support shaft;

a flexible protection cover, disposed on the fixed plate, including:

a sheet-like body, configured to couple the fixed plate; and a hollow protrusion structure, formed on the sheet-like body and configured to partially cover the key pedestal, an opening being provided at a top end of the hollow protrusion structure, and the key support shaft being correspondingly configured at a position of the opening.

In the foregoing preferred embodiment, the hollow protrusion structure bends inwards at an end of the opening and forms an extending part extending towards the keycap.

In the foregoing preferred embodiment, a material of the flexible protection cover is: rubber or silicon.

In the foregoing preferred embodiment, at least one stop structure is provided on a circumferential surface of the key pedestal.

In the foregoing preferred embodiment, the fixed plate is provided with a fixing hole, the key pedestal passes through the fixing hole, and the stop structure presses against a surface of the fixed plate.

In the foregoing preferred embodiment, at least one bent structure is provided at a connection between the hollow protrusion structure and the sheet-like body, and the at least one bent structure is configured to cover the stop structure.

The present invention additionally provides a keyboard, including:

a lower cover;

a fixed plate, fixedly disposed on the lower cover;

a plurality of keys, disposed on the fixed plate, and each being provided with:

a key pedestal, fixedly disposed on the fixed plate and having a key support shaft; and a keycap, coupled to the key support shaft;

a flexible protection cover, disposed on the fixed plate, including:

a sheet-like body, configured to couple the fixed plate; and a plurality of hollow protrusion structures, formed on the sheet-like body, the plurality of hollow protrusion structures each being configured to partially cover the key pedestal, an opening being provided at a top end of each of the hollow protrusion structures, and the key support shaft being correspondingly configured at a position of the opening; and an upper cover, disposed on the sheet-like body and assembled to the lower cover, a recess being provided on the upper cover, and the hollow protrusion structures being located in the recess.

In the foregoing preferred embodiment, the hollow protrusion structure bends inwards at an end of the opening and forms an extending part extending towards the keycap.

In the foregoing preferred embodiment, a material of the flexible protection cover is: rubber or silicon.

In the foregoing preferred embodiment, at least one stop structure is provided on a circumferential surface of the key pedestal.

In the foregoing preferred embodiment, the fixed plate is provided with a plurality of fixing holes, the key pedestal passes through the fixing holes, and the stop structure presses against a surface of the fixed plate.

In the foregoing preferred embodiment, at least one bent structure is provided at a connection between the hollow protrusion structure and the sheet-like body, and the at least one bent structure is configured to cover the stop structure.

In the foregoing preferred embodiment, the keyboard further includes a switch circuit board, the switch circuit board being disposed between the lower cover and the fixed plate.

In the foregoing preferred embodiment, a limit column is provided at a bottom end of the key pedestal, a limit hole corresponding to the limit column is provided on the switch circuit board, and the limit column passes through the limit hole.

DETAILED DESCRIPTION OF THE PREFERRED EMBODIMENT

More detailed descriptions are made with reference to the examples of the embodiments and the accompanying drawings, to make advantages and features of the present invention and the method to implement the present invention easier to understand. However, the present invention may be implemented in different forms and it should not be understood that the present invention can be implemented only by using the embodiments described herein. On the contrary, for persons of ordinary skill in the art, the provided embodiments will make the disclosure more apparent and comprehensive and completely convey the scope of the present invention.

Figure 1A:
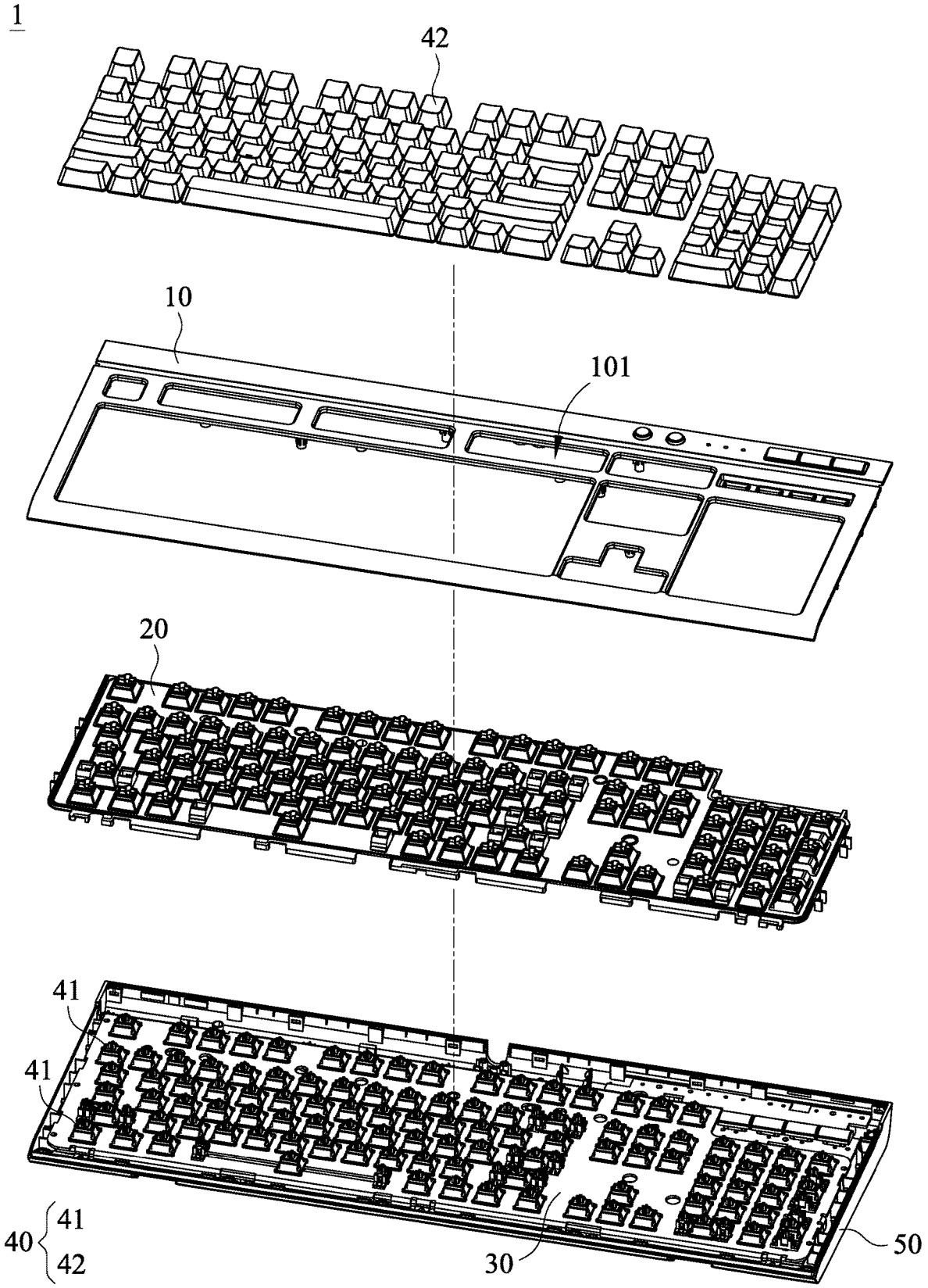
FIG. 1A is a three-dimensional exploded view of a keyboard according to the present invention.
Figure 1B:
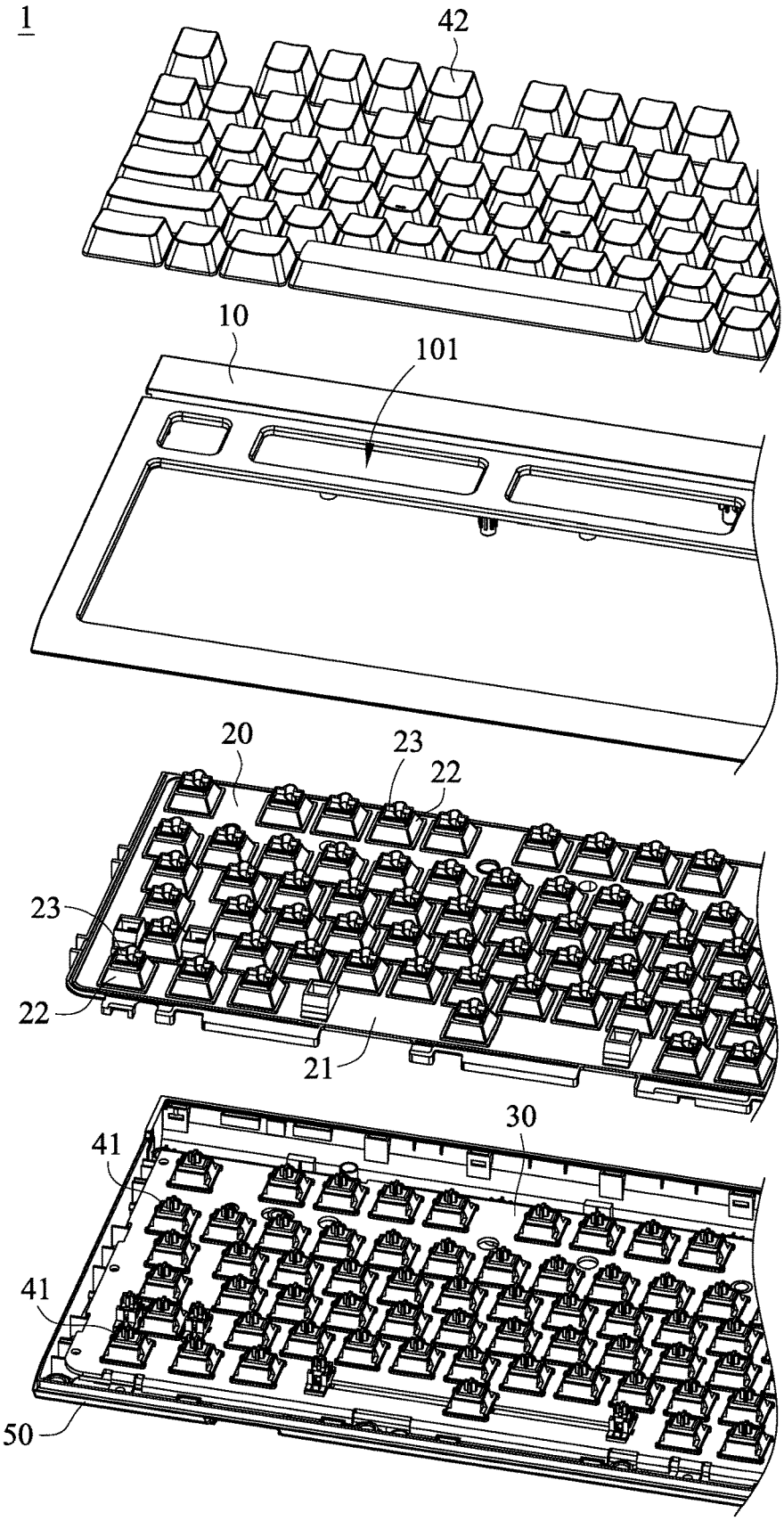
FIG. 1B is a three-dimensional exploded view of a partially enlarged part of a keyboard according to the present invention.
Figure 1C:
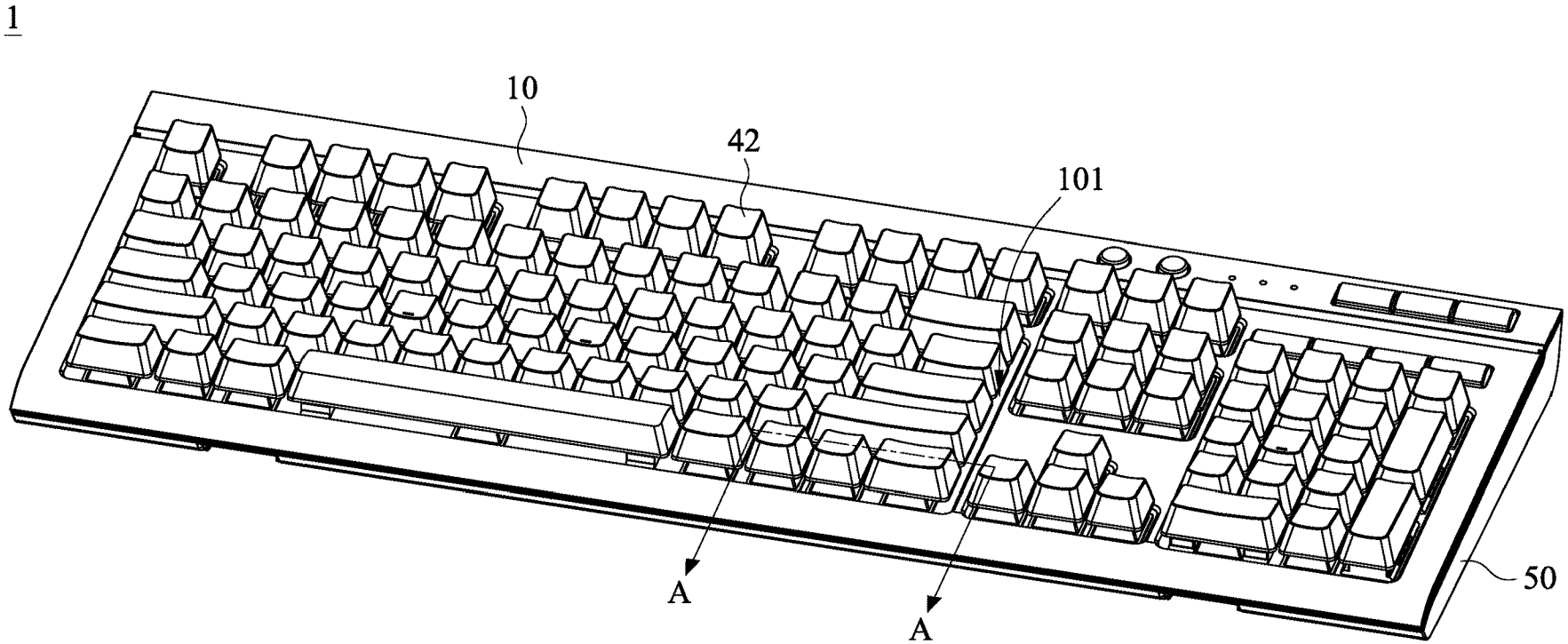
FIG. 1C is a schematic three-dimensional diagram of a keyboard according to the present invention.

First referring to FIG. 1A, FIG. 1B, and FIG. 1C, FIG. 1A is a three-dimensional exploded view of a keyboard according to the present invention, FIG. 1B is a three-dimensional exploded view of a partially enlarged part of a keyboard according to the present invention, and FIG. 1C is a schematic three-dimensional diagram of a keyboard according to the present invention. The keyboard 1 includes: an upper cover 10, a flexible protection cover 20, a fixed plate 30, a plurality of keys 40, and a lower cover 50.

Still referring to FIG. 1B, the fixed plate 30 is fixedly disposed on the lower cover 50, the plurality of keys 40 each is provided with a key pedestal 41 and a keycap 42 coupled to the key pedestal 41, and the key pedestal 41 is fixedly disposed on the fixed plate 30. The flexible protection cover 20 for proofing water and dusts is disposed on the fixed plate 30, and a material of the flexible protection cover 20 may be: rubber or silicon, so that the flexible protection cover 20 is elastic and can bend and deform. Moreover, the flexible protection cover 20 includes: a sheet-like body 21 and a plurality of hollow protrusion structures 22 formed on the sheet-like body 21, and an opening 23 is provided at a top end of each of the plurality of hollow protrusion structures 22. The sheet-like body 21 is configured to couple the fixed plate 30; the plurality of hollow protrusion structures 22 is corresponding to the plurality of key pedestals 41, and is configured to partially cover each of the key pedestals 41 respectively; and the opening 23 is configured to configure and expose a coupling end of the key pedestal 41 and the keycap 42. The upper cover 10 is disposed on the sheet-like body 21 and can be assembled together with the lower cover 50, the upper cover 10 is provided with a recess 101 running through the upper cover 10, and the plurality of hollow protrusion structures 22 is configured in the recess 101. In this embodiment, to avoid mutual interference between the keycap 42 and the upper cover 10, the upper cover 10 first covers the flexible protection cover 20, to expose the plurality of hollow protrusion structures 22 out of the recess 101, and then the keycaps 42 are coupled to the key pedestals 41. However, in actual use, if the keycaps 42 do not interfere with the upper cover 10, the keycaps 42 may first be coupled to the key pedestals 41 and then the upper cover 10 covers the flexible protection cover 20.

Figure 2A:
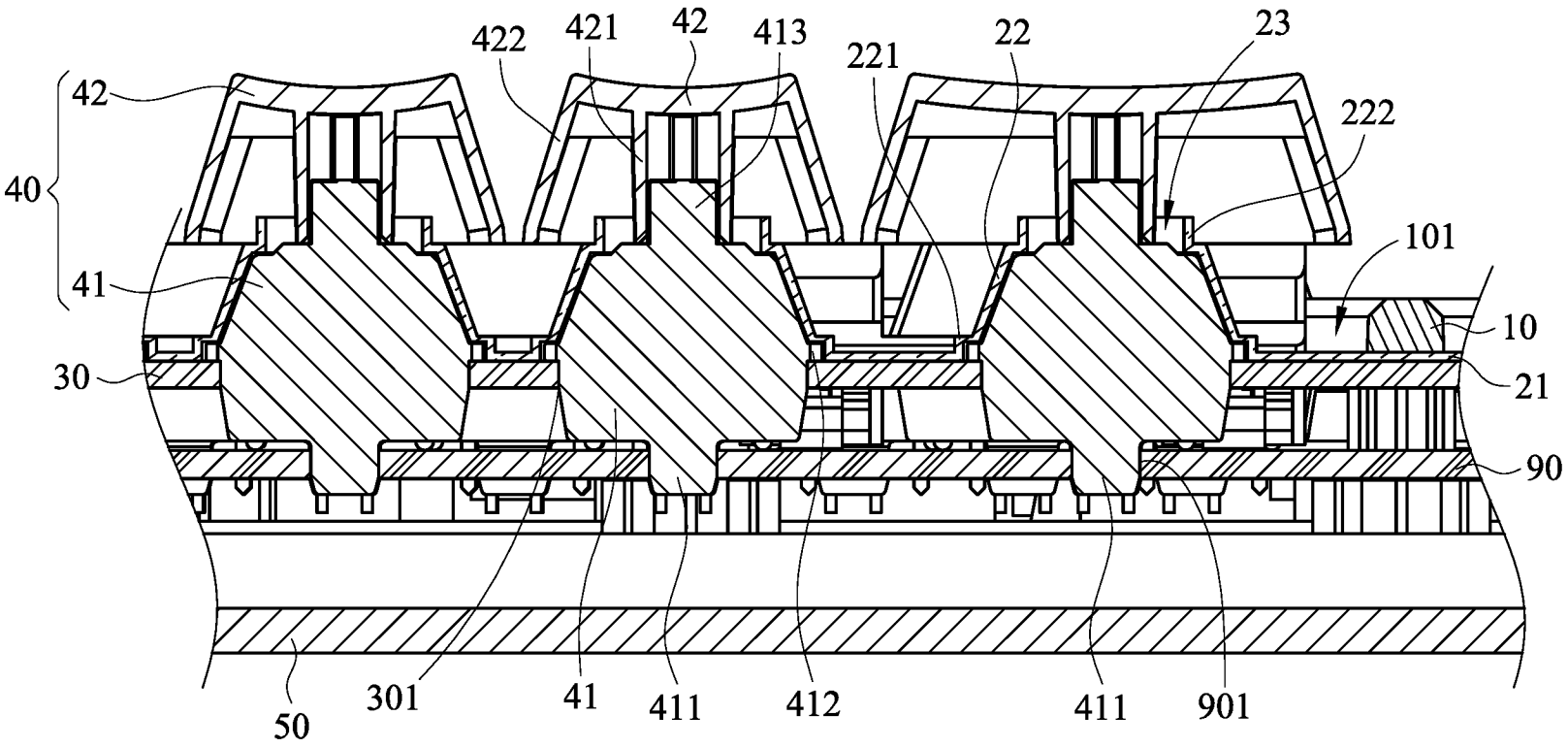
FIG. 2A is a schematic cross-sectional view of the keyboard of FIG. 1C along line A-A.
Figure 2B:
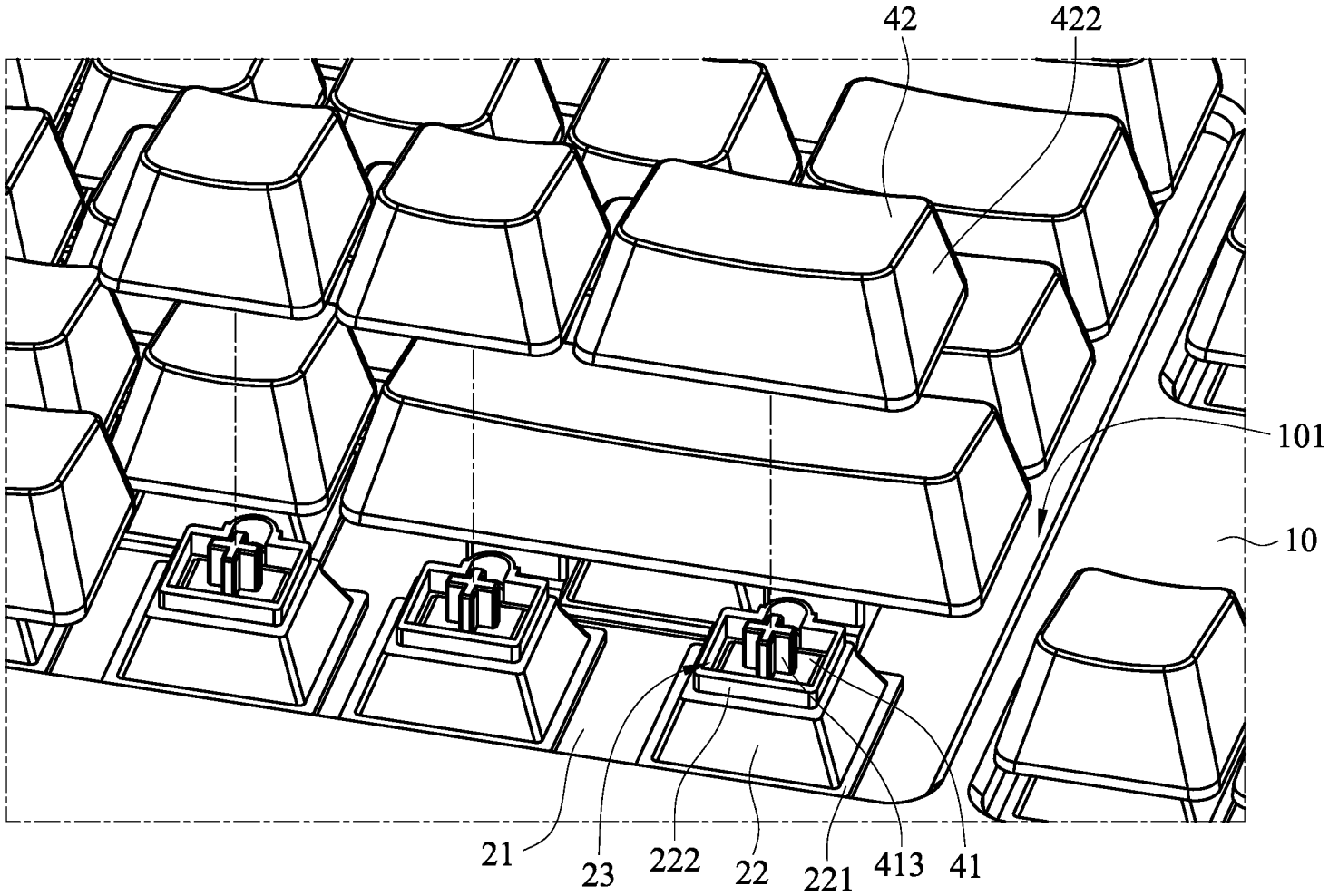
FIG. 2B is a schematic three-dimensional diagram of a partially enlarged part of a key structure according to the present invention.

Referring to FIG. 2A and FIG. 2B, FIG. 2A is a schematic cross-sectional view of the keyboard of FIG. 1C along line A-A, and FIG. 2B is a schematic three-dimensional diagram of a partially enlarged part of a key structure according to the present invention. In FIG. 2A, key pedestal 41 is provided with a limit column 411 disposed at a bottom end, a stop structure 412 disposed on a circumferential surface of the key pedestal 41, and a key support shaft 413 disposed at a top end; the keycap 42 is provided with a skirt structure 422 and a fit structure 421 located on a lower surface of the keycap 42; the fixed plate 30 is provided with a plurality of fixing holes 301, and a switch circuit board 90 disposed between the lower cover 50 and the fixed plate 30 is provided with a plurality of limit holes 901 corresponding to the limit columns 411. The key pedestal 41 passes through the fixing hole 301, and presses against a surface of the fixed plate 30 by means of the stop structure 412, and the limit column 411 passes through the limit hole 901, to enable the key pedestal 41 to accurately correspond to a switch position (not shown) on the switch circuit board 90.

The sheet-like body 21 of the flexible protection cover 20 is coupled to the fixed plate 30, the hollow protrusion structure 22 is configured to partially cover a surface of the key pedestal 41, and the key support shaft 413 is correspondingly configured in the position of the opening 23. The keycap 42 fits with the key support shaft 413 by means of the fit structure 421, to be coupled onto the key pedestal 41. In this embodiment, the key 40 is a mechanical key, and when a user presses the keycap 42, the keycap 42 moves downwards to push the key support shaft 413, so that a linkage (not shown) in the key pedestal 41 moves downwards, to drive an elastic part (not shown) to drive the switch circuit board 90 to output a corresponding key signal.

A bent structure 221 with a shape corresponding to that of the stop structure 412 is provided at a connection between the hollow protrusion structure 22 and the sheet-like body 21, so that the bent structure 221 may completely cover the stop structure 412. In addition, the hollow protrusion structure 22 bends inwards at an end of the opening 23 and forms an extending part 222 extending towards the keycap 42. By disposing the extending part 222, the skirt structure 422 of the keycap 42 may completely shield the opening 23 of the hollow protrusion structure 22, so that water drops or dusts are prevented from entering the opening 23 from side angles. In this way, the water-proof and dust-proof efficacy of the flexible protection cover 20 can be improved.

As compared with the existing technology, the water-proof and dust-proof efficacy of the keyboard and the key structure thereof provided in the present invention can be improved by using a flexible protection cover. Therefore, the present invention is a creation of extraordinary industrial value.

Any modification made to the present invention by persons skilled in the art by means of technical measures shall fall within the protection scope of the claims.

What is claimed is:

1. A key structure, comprising:

a fixed plate;

a key pedestal, fixedly disposed on the fixed plate and having a key support shaft, wherein at least one stop structure is provided on a circumferential surface of the key pedestal and presses against an upper surface of the fixed plate;

a keycap, coupled to the key support shaft;

a flexible protection cover, disposed on an upper surface of the fixed plate, comprising:

a sheet-like body, configured to contact and overlay substantially all of the upper surface of the fixed plate; and a hollow protrusion structure, formed on the sheet-like body and configured to partially cover the key pedestal, an opening being provided at a top end of the hollow protrusion structure, and the key support shaft being correspondingly configured at a position of the opening.

2. The key structure according to claim 1, wherein the hollow protrusion structure bends inwards at an end of the opening and forms an extending part extending towards the keycap.

3. The key structure according to claim 1, wherein a material of the flexible protection cover is: rubber or silicon.

4. The key structure according to claim 1, wherein the fixed plate is provided with a fixing hole, and the key pedestal passes through the fixing hole.

5. The key structure according to claim 1, wherein at least one bent structure is provided at a connection between the hollow protrusion structure and the sheet-like body, and the at least one bent structure is configured to cover the at least one stop structure.

6. A keyboard, comprising:

a lower cover;

a fixed plate, fixedly disposed on the lower cover;

a plurality of keys, disposed on the fixed plate, and each being provided with:

a key pedestal, fixedly disposed on the fixed plate and having a key support shaft, wherein at least one stop structure is provided on a circumferential surface of the key pedestal and presses against an upper surface of the fixed plate; and a keycap, coupled to the key support shaft;

a flexible protection cover, disposed on an upper surface of the fixed plate, comprising:

a sheet-like body, configured to contact and overlay substantially all of the upper surface of the fixed plate; and a plurality of hollow protrusion structures, formed on the sheet-like body, the plurality of hollow protrusion structures each being configured to partially cover the key pedestal, an opening being provided at a top end of each of the hollow protrusion structures, and the key support shaft being correspondingly configured at a position of the opening; and an upper cover, disposed on the sheet-like body and assembled to the lower cover, at least one recess being provided on the upper cover, and the hollow protrusion structures being located in the at least one recess.

7. The keyboard according to claim 6, wherein the hollow protrusion structure bends inwards at an end of the opening and forms an extending part extending towards the keycap.

8. The keyboard according to claim 6, wherein a material of the flexible protection cover is: rubber or silicon.

9. The keyboard according to claim 6, wherein the fixed plate is provided with a plurality of fixing holes, and the key pedestal passes through one of the fixing holes.

10. The keyboard according to claim 6, wherein at least one bent structure is provided at a connection between the hollow protrusion structure and the sheet-like body, and the at least one bent structure is configured to cover the at least one stop structure.

11. The keyboard according to claim 6, further comprising a switch circuit board, the switch circuit board being disposed between the lower cover and the fixed plate.

12. The keyboard according to claim 11, wherein a limit column is provided at a bottom end of the key pedestal, a limit hole corresponding to the limit column is provided on the switch circuit board, and the limit column passes through the limit hole.

* * * * *